United States Patent [19]

Green

[11] Patent Number: 4,726,284

[45] Date of Patent: Feb. 23, 1988

[54] HYDRAULIC CYLINDER

[76] Inventor: Robert H. Green, 17518 Euler Rd., Bowling Green, Ohio 43402

[21] Appl. No.: 825,374

[22] Filed: Feb. 3, 1986

[51] Int. Cl.[4] ..... F01B 29/00

[52] U.S. Cl. ..... 92/128; 92/165 PR; 92/181 P; 91/401

[58] Field of Search ..... 92/128, 181 P, 165 R, 92/165 PR, 13, 13.6; 91/401; 403/348, 353, 383

[56] References Cited

U.S. PATENT DOCUMENTS

| | | | |
|---|---|---|---|
| 897,231 | 8/1908 | Waugh | 92/165 R X |
| 1,199,690 | 9/1916 | Gillan | 403/348 X |
| 1,713,906 | 5/1929 | Lake | 92/51 |
| 1,928,533 | 9/1933 | Goss | 254/93 |
| 2,198,196 | 4/1940 | Goldup | 92/13 X |
| 2,724,368 | 11/1955 | Miller | 121/38 |
| 2,811,950 | 11/1957 | Entz | 92/128 X |
| 2,819,934 | 1/1958 | Luterick | 309/2 |
| 2,853,347 | 9/1958 | Cooper, Jr. | 309/17 |
| 2,997,026 | 8/1961 | Zimmerer | 121/38 |
| 3,486,419 | 12/1969 | Linkin | 92/128 |
| 3,528,346 | 9/1970 | Lee | 92/128 |
| 3,538,575 | 11/1970 | Roland | 92/128 X |
| 3,650,182 | 3/1972 | Phillips | 92/128 |
| 3,721,162 | 3/1973 | Kulhavy | 92/128 |
| 3,853,038 | 12/1974 | Roland | 92/128 |
| 4,014,195 | 3/1977 | Grogan | 403/353 X |
| 4,242,947 | 1/1981 | Renner et al. | 92/165 R X |
| 4,357,858 | 11/1982 | Wedman | 92/128 |

FOREIGN PATENT DOCUMENTS

| | | | |
|---|---|---|---|
| 2261705 | 6/1974 | Fed. Rep. of Germany | 92/13.6 |

*Primary Examiner*—Robert E. Garrett
*Assistant Examiner*—Mark A. Williamson
*Attorney, Agent, or Firm*—Emch, Schaffer, Schaub & Porcello Co.

[57] ABSTRACT

A hydraulic cylinder is disclosed having a hollow cylinder with a closed first end and an open second end. A rod is positioned in the interior of the hollow cylinder and the rod is securely connected to the first end of the cylinder. The rod is positioned in substantially the center of the hollow cylinder and is substantially parallel to the longitudinal axis of the cylinder. The end of the rod that is spaced apart from the first end of the cylinder has an area of enlarged cross-section. A movable piston having a first end and a second end positioned with the first end of the piston being in the interior of the hollow cylinder. The second end of the piston extends from the open end of the hollow cylinder. The first end of the piston defines a slot for receiving the end of the rod having an enlarged cross-section. The slot is disposed to receive the end of the rod having the enlarged cross-section when the slot and the end of the rod are properly aligned. The piston is rotatable to change alignment between the slot and the end of the rod to prevent the piston from being removed from the rod and from the cylinder. There is also provided an orifice in said piston adjacent said first end of the piston. The orifice moves into communication with the atmosphere if the piston exceeds the desired range of movement in a direction towards the seceond end of the hollow cylinder. The orifice then vents the hydraulic fluid driving the piston to the atmosphere and the advancement of the piston stops.

19 Claims, 10 Drawing Figures

HYDRAULIC CYLINDER

BACKGROUND OF THE INVENTION

This invention relates to a hydraulic cylinder that is easily disassembled. More particularly, the hydraulic cylinder has an easily removable piston that simplifies maintenance and repair work on the cylinder.

The invention provides a construction for a hydraulic cylinder which eliminates the need for providing a removable cylinder head for the cylinder or barrel of the unit. This eliminates the difficulty of providing a pressure seal between the head and barrel of the cylinder. It also greatly reduces the cost of fabrication and assembly for the hydraulic cylinder.

Unitary or integrally formed hydraulic cylinders have been used for years. These cylinders present difficulties relating to the means by which the piston is mounted in the cylinder and the means by which the piston is retained in the cylinder during normal operation. Such unitary cylinders are frequently cast in one piece or formed of welded construction such that the piston is inserted into the completed cylinder through a bore which slideably and sealingly engages a piston in normal use. However, there have been difficulties providing a satisfactory means for retaining the piston in the cylinder and also allowing for removal of the piston when desired.

Various methods have been proposed including the use of snap rings, threaded extensions and the like which must be introduced into the cylinder and coupled to the piston. In many of these systems the cylinder must be machined or cast of a particular configuration to accommodate the ingress and internal positioning of the retaining member for subsequent coupling to the piston within the cylinder. The cost of machining and fabricating such a unit is usually very high. Other prior art cylinders require introduction of a tool into a special tool access opening in the cylinder to remove the retaining member from the piston to permit the piston to be withdrawn from the cylinder.

It is an object of the invention to provide a construction for a hydraulic cylinder which provides for easy removal of the piston from the cylinder.

It is a further object of the invention to provide a hydraulic cylinder where the piston can be removed from the cylinder without using special tools or access ports in the cylinder.

Other objects and advantages of the invention will be clear from the following description of the invention.

SUMMARY OF THE INVENTION

The invention is directed to a hydraulic cylinder having a hollow cylinder with a closed first end and an open second end. A rod is positioned in the interior of the hollow cylinder and the rod is securely connected to the first end of the cylinder. The rod is positioned in substantially the center of the hollow cylinder and is substantially parallel to the longitudinal axis of the cylinder. The end of the rod that is spaced apart from the first end of the cylinder has an area of enlarged cross-section. A movable piston having a first end and a second end positioned with the first end of the piston being in the interior of the hollow cylinder. The second end of the piston extends from the open end of the hollow cylinder. The first end of the piston defines a slot for receiving the end of the rod having an enlarged cross-section. The slot is disposed to receive the end of the rod having the enlarged cross-section when the slot and the end of the rod are properly aligned. The piston is rotatable to change alignment between the slot and the end of the rod to prevent the piston from being removed from the rod and from the cylinder. There is also provided an orifice in said piston adjacent said first end of the piston. The orifice moves into communication with the atmosphere if the piston exceeds the desired range of movement in a direction towards the second end of the hollow cylinder. The orifice then vents the hydraulic fluid driving the piston to the atmosphere and the advancement of the piston stops.

DESCRIPTION OF THE PREFERRED EMBODIMENTS

Figure 1:
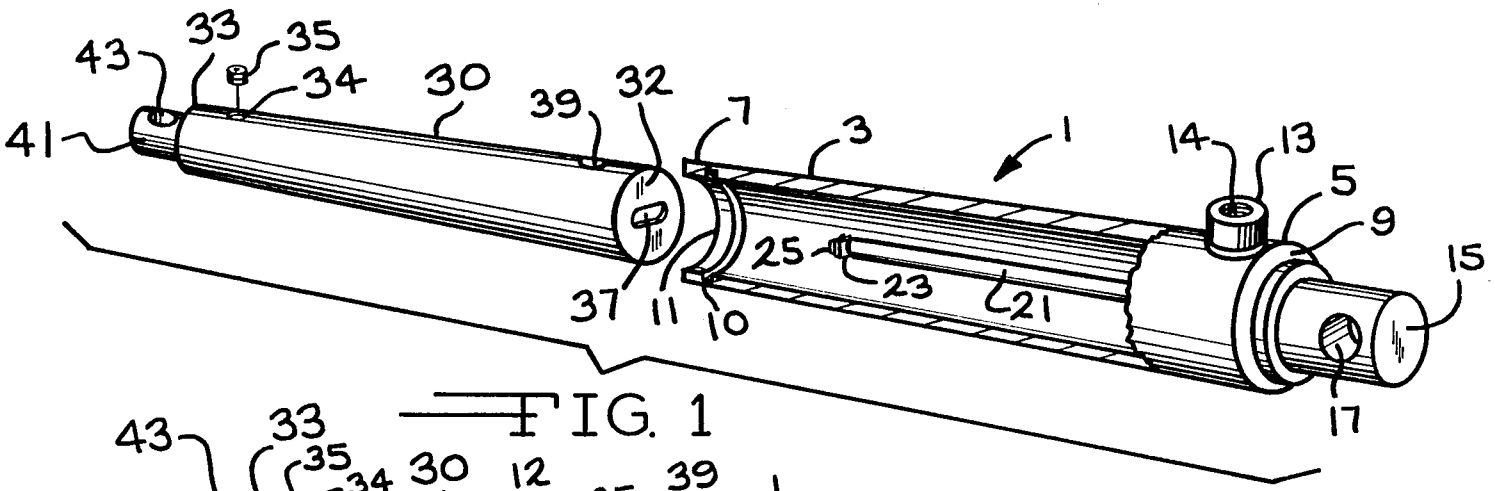
FIG. 1 is a perspective view, partially broken away, of the invention of the present application.
Figure 2:
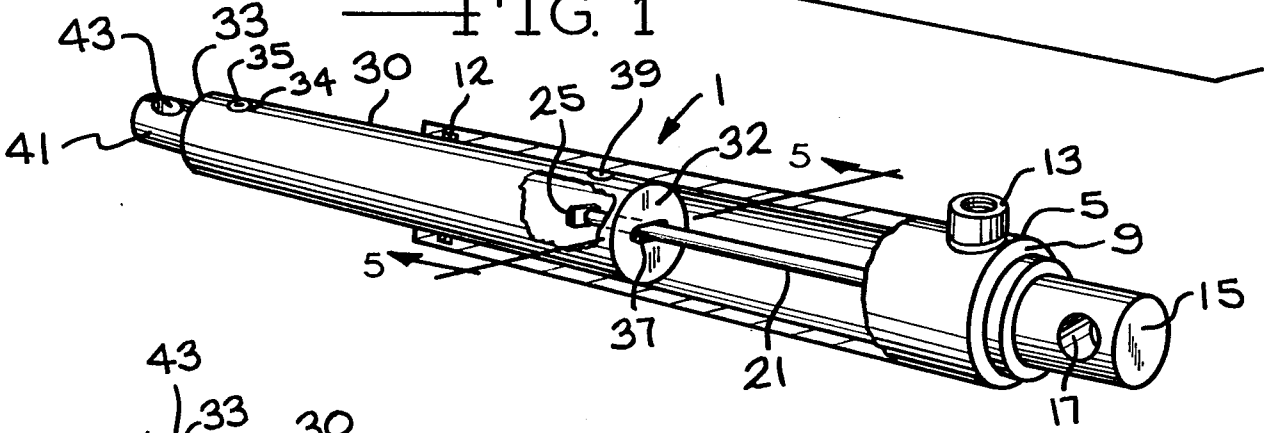
FIG. 2 is a partially broken away perspective view.
Figure 3:
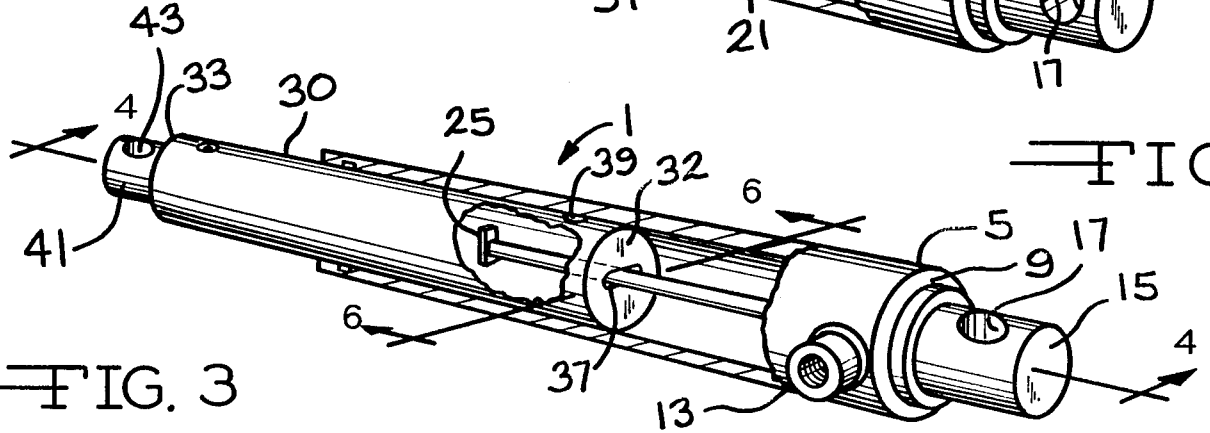
FIG. 3 is a partially broken away perspective view.

The invention relates to a hydraulic cylinder that is easy to assemble and disassemble. More particularly, the piston of the hydraulic cylinder is positioned on a rod that is located in the cylinder. The piston having a slot for receiving the rod and the end of the rod that extends into the piston has an enlarged cross section. The piston is capable of being turned so that the area of enlarged cross section on the rod will no longer fit the slot in the piston and the cylinder will be maintained in the hollow cylinder of the hydraulic cylinder. Other features and advantages of the invention will be more fully understood by referring to the attached drawings in connection with the following description.

The hydraulic cylinder 1 has a hollow outer cylinder 3 having a first end 5 and a second end 7. The first end 5 of the hollow cylinder 3 is closed and has a end cap 9 positioned thereon. The second end 7 is open and defines a substantially circular opening 11. A substantially circular recess 10 is positioned on the interior of the outer cylinder 3 adjacent the circular opening 11. The recess 10 is disposed substantially perpendicular to an axis passing through the center of the hollow outer cylinder 3. A seal 12 is positioned in the recess 10. The seal 12 extends from the recess into the interior of the hollow outer cylinder a very small distance. Normally, the seal is made of a flexible soft material, however, any suitable material can be used for the seal. An inlet port 13 is positioned on the outer cylinder adjacent the first end 5. The inlet port defines a passageway 14 that extends into the interior of the hollow outer cylinder. Secured to the end cap 9 is a cylindrical fitting 15. A passageway 17 extends through the cylindrical fitting 15 and the passageway is disposed to be substantially perpendicular to the side walls of the hollow cylinder 3.

Positioned in the interior of the hollow cylinder 3 is rod 21. The rod is secured to the first end 5 of the hollow cylinder 3 and extends from the first end in a direction towards the second end 7 of the hollow cylinder 3. A rod 21 is normally substantially cylindrical in shape. The rod 21 normally extends at least one-half of the length of the hollow cylinder 3. In practice it has been found to be most desirable to have the rod 21 extend from about ½ to about 4/5 of the length of the hollow cylinder 3. The end of the rod 21 that is spaced apart from the first end 5 of the hollow cylinder 3 has an area of enlarged cross section 23. The area of enlarged cross section extends from at least one side of the rod and usually extends from opposed sides of the rod. In practice it has been found that an area of enlarged cross section 23 that extends only on two sides of the rod works particularly well with the invention. Normally, the area of enlarge cross section is a T-shaped section 25 and the T-shaped section is positioned to be substantially perpendicular to the longitudinal axis of the rod 21. The T-shape section 25 has a width that is greater than the diameter of the rod 21 and the T-shaped section extends from each side of the rod 21. It has been found that the T-shaped section should have a width that is from about 1¼ to about 3 times wider than the diameter of the rod 21. The T-shaped section also has a height and the height of the T-shaped section is substantially the same as the diameter of the rod 21. Accordingly, the T-shaped section only extends from two sides of the rod 21.

A moveable, hollow piston 30 is designed to be positioned in the hollow cylinder 3 of the hydraulic cylinder 1. The hollow piston 30 has a diameter that is slightly smaller than the interior diameter of the hollow cylinder 3 and this allows the hollow piston 30 to be slideably positioned in the hollow cylinder 3. The diameter of the piston is larger than the opening formed by the seal 12 in the recess 10. Thus, the piston 30 will deform the seal when the piston is positioned in the outer cylinder and the seal 12 will be in contact with the sidewalls of the piston. The moveable piston has a first end 32 and a second end 33. A threaded aperture 34 is located adjacent the second end 33 of the piston. The aperture 34 extends into the hollow interior of the piston. A threaded plug 35 can be positioned in the aperture to close the aperture. A slot 37 is positioned in the first end 32 of the hollow piston 30. The slot 37 is disposed to be in substantial alignment with the rod 21 that is positioned in the hollow cylinder 3. The slot 37 has width that is at least slightly larger than the width of the area of enlarged cross section 23 on the end of the rod 21 that is spaced apart from the first end 5 of the hollow cylinder 3. If the area of enlarged cross-section is a T-shaped section 25 the width of the slot 37 is at least slightly larger than the width of the T-shaped section. The height of the slot 37 is slightly larger than the diameter of the rod 21 and the height of the area of enlarged cross section. Accordingly, if the slot 37 is properly aligned with the area of enlarged cross section 23 on the end of the rod 21, the rod 21 will advance into the interior of the hollow piston 30 as the hollow piston 30 is advanced into the hollow cylinder 3. Once the hollow piston 30 has been inserted into the hollow cylinder 3, the cylinder can be rotated approximately 90° to that the area of enlarged cross section 23 on the rod 21 is no longer in alignment with the slot 37. This acts to mantain the hollow piston 30 in the hollow cylinder 3 and prevent the piston from being removed from the hollow cylinder 3.

An orifice 39 is positioned in the piston adjacent the first end 32 of the piston. The orifice 39 extends through the wall of the piston and is in communication with the hollow interior of the piston. The orifice is disposed so that the orifice is adjacent to the side of the seal 12 that is spaced apart from the opening 11 when the first end 32 of the piston 30 is adjacent the area of enlarged cross section 23 on the rod 21. Accordingly, when the piston 30 is properly positioned on the rod 21 in the outer cylinder 3, the orifice 39 is positioned in the outer cylinder on the side of the seal 12 that is spaced apart from the opening 11.

The second end 33 of the hollow piston 30 has a cylindrical bracket 41 positioned thereon. The cylindrical bracket is securely affixed to the second end of the hollow piston 30. A passageway 43 extends through the cylindrical bracket 41. The passageway 43 is disposed to be substantially perpendicular to the side walls of the hollow cylinder 3. The cylindrical fitting 15 on the first end 5 of the hollow cylinder 3 and the cylindrical bracket 41 on the hollow piston 30 are used to connect the hydraulic cylinder to a workpiece. Normally, a bolt or other fastening device will be positioned in the passageway 17 in the cylindrical fitting 15 and a similar bolt will be positioned in the passageway 43 in the cylindrical bracket 41 to secure the hydraulic cylinder to the workpiece. It should be noted that the slot 37 in the hollow piston 30 will align with the area of enlarged cross section 23 on the rod 21 when an axis extending through the passageway 43 is disposed perpendicular to an axis passing through the passageway 17 in a cylindrical fitting 15. Thus, it is easy to align the hollow piston 30 so that the slot 37 is in alignment with the area of enlarged cross-section 23 on the rod 21. It is only necessary to view the position of the passageway 43 relative to the passageway 17 and that these passageways are disposed approximately 90° from one another. When the passageways are so aligned the slot 37 will be properly aligned to receive the area of enlarged cross section 23 on the rod 21 and the hollow piston 30 can be inserted into the hollow cylinder 3. Once the hollow piston 30 has been inserted into the hollow cylinder 3, the piston can be rotated approximately 90° so that the passageway 17 and the passageway 43 are orientated in parallel relationship so that the slot 37 will no longer be in alignment with the area of enlarge cross section 23 on the rod 21. It should also be noted that the inlet port 13 on the first end 5 of the hollow cylinder 3 is disposed in substantially perpendicular alignment with the passageway 17 in the cylindrical fitting 15. Accordingly, the inlet port 13 can also be used as an alignment means to properly orient the hollow piston 30 when inserting the piston into the hollow cylinder 3.

Figure 4:
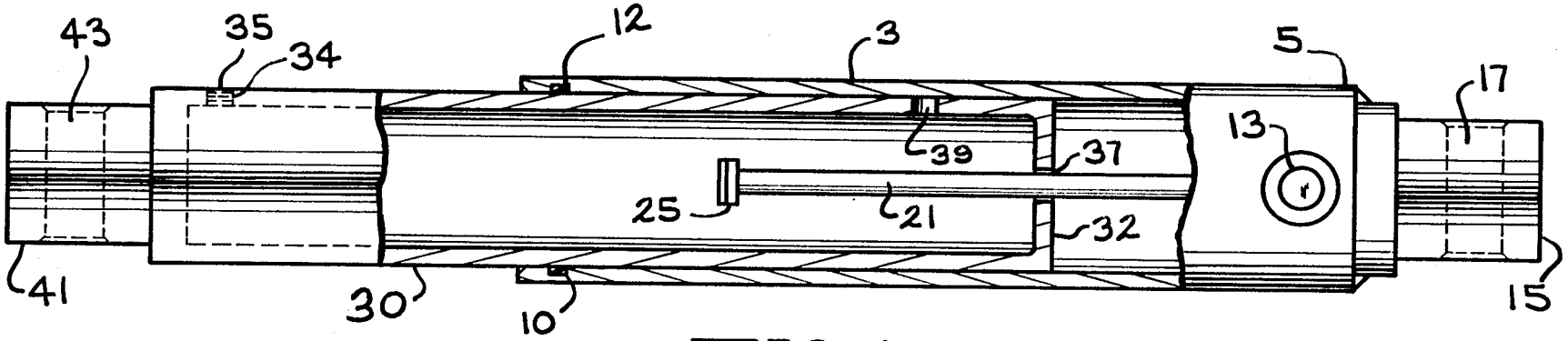
FIG. 4 is a cross-sectional view taken along line 4—4 shown in FIG. 3.
Figure 6:
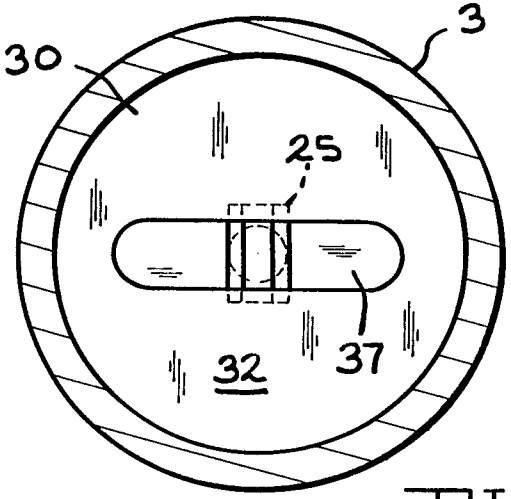
FIG. 6 is a cross-sectional view taken along line 6—6 shown in FIG. 3.
Figure 5:
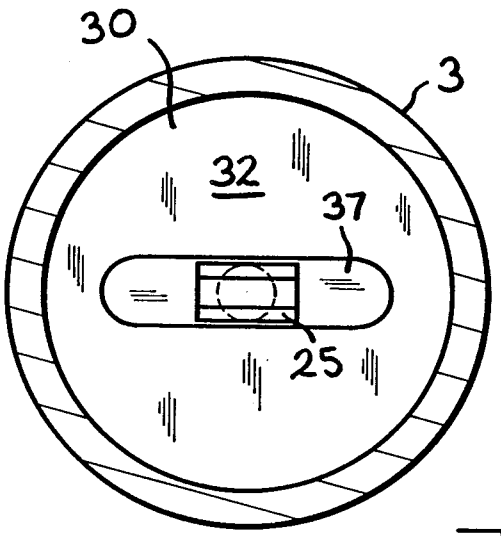
FIG. 5 is a cross-sectional view taken along line 5—5 shown in FIG. 2.
Figure 7:
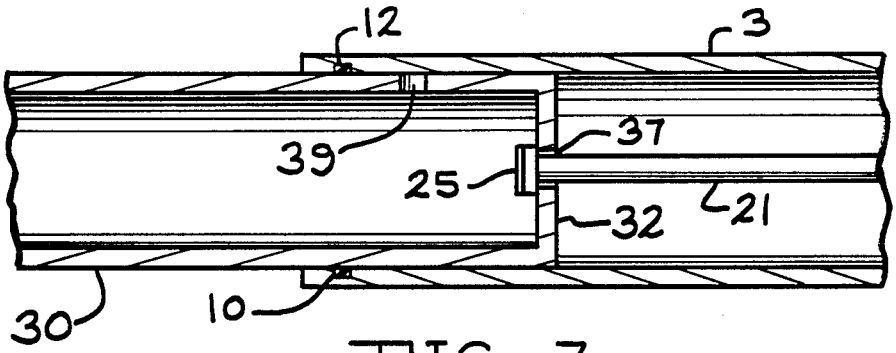
FIG. 7 is a partial cross-sectional view of the invention.

In operation, the cylindrical fitting 15 on the hydraulic cylinder 1 is connected to one end of a machine by a rod or bolt that extends through passageway 17. The cylindrical bracket 41 on the hollow piston 30 is also connected to a the machine by means of a rod or bolt that extends through passageway 43. The cylinder is designed so that the passageway 17 and passageway 43 will be substantially parallel, as shown in FIG. 4, when the hydraulic cylinder 1 is properly mounted on the machine. Hydraulic fluid is then introduced in through the inlet port 13 into the hollow cylinder 3 and the hydraulic fluid causes the hollow piston 30 to advance in a direction away from the first end 5 of the hollow cylinder 3. The hollow piston 30 normally advances a predetermined distance to move a portion of the machine. The hollow piston 30 can be returned to its initial starting point and can again be caused to advance by the introduction of hydraulic fluid through the inlet port 13. Accordingly, the moveable hollow piston 30 is moved back and forth in the hollow cylinder 3. The seal 12 engages the sides of the piston 30 and prevents hydraulic fluid from escaping from the outer cylinder 3. It is also possible to introduce the hydraulic fluid into the hydraulic cylinder 1 through threaded aperture 34 by removing the plug 35 and threading an inlet connection into the aperture. It is also possible to use the aperture 34 to bleed air from the hydraulic cylinder when hydraulic fluid is introduced through the inlet port 13.

The travel of the piston 30 can cause wear in the seals located at the second end 7 of the hollow cylinder 3. To disassemble the hydraulic cylinder 1 to replace the seal or to perform other maintenance work on the hydraulic cylinder, the cylindrical bracket 41 must be disengaged from the machine and the hollow piston 30 rotated approximately 90° so that the passageway 43 in the cylindrical bracket 41 is in substantial alignment with the inlet port 13. This causes the slot 37 in the first end 32 of the hollow piston 30 to be aligned with the area of enlarged cross-section 23 on the rod 21. The piston 30 can then be withdrawn from the hollow cylinder 3 so that the seal 12 in the second end 7 of the hollow cylinder 3 can be inspected or replaced and other maintenance can be carried out on the hollow cylinder 3 and the piston 30. To reassemble the hydraulic cylinder, it is only necessary to reinsert the hollow piston 30 with the slot 37 in alignment with the area of enlarged cross section 23 on the rod 21. Once the piston 30 has been inserted into the hollow cylinder 3, the piston is rotated substantially 90° so that the slot 37 is no longer in alignment with the area of enlarged cross section 23 on the rod 21. Once the piston has been rotated the area of enlarged cross-section will prevent the piston 30 from being withdrawn from the hollow cylinder 3. Thus, the area of enlarged cross section 23 on the rod 21 will prevent the piston 30 from being accidentally removed from the hollow cylinder 3 either by the improper application of hydraulic fluid to the cylinder or by other tampering with the hydraulic cylinder. The area of enlarged cross section is designed to be able to withstand at least four (4) times the force generated by the working pressure of the hydraulic fluid that is used to advance the piston 30. Thus, the area of enlarged cross section has a safety factor of at least four (4) times the force normally encountered in the hydraulic cylinder 1.

Figure 8:
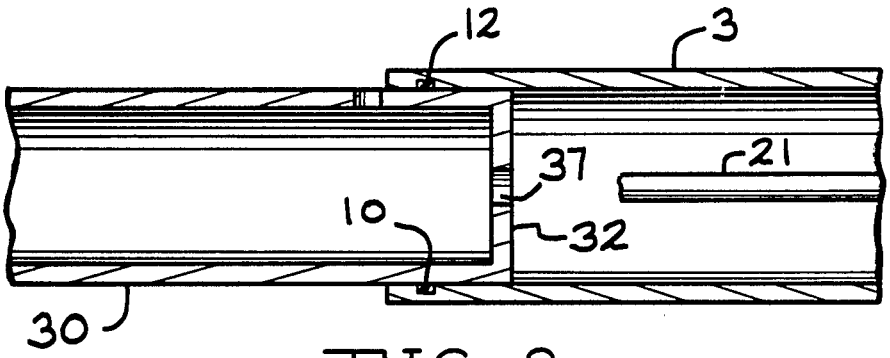
FIG. 8 is a partial cross-sectional view.

The orifice 39 provides an additional safety feature for the hydraulic cylinder 1. The orifice 39 is disposed on the moveable hollow piston 30 so that the orifice is located inside the hollow cylinder 3 when the piston 30 is positioned on the rod 21. The orifice 39 is also positioned so that it is on the side of the seal 12 that is spaced apart from the circular opening 11 for the hollow cylinder 3. Accordingly, when the piston 30 is properly positioned on the rod 21 the orifice 39 is only in communication with the interior of the hollow cylinder 3 and the interior of the hollow piston 30 and does not effect the operation of the hydraulic cylinder 1. However, if the area of enlarged cross section 23 on the end of the rod 21 that limits the travel of the piston 30 should ever fail or break during operation of the hydraulic cylinder 1, a potentially dangerous situation could exist where the piston 30 would be unrestrained in its movement and could result in personal injury or damage to expensive equipment. However, as shown in FIG. 8, if the area of enlarged cross section on the rod 21 should fail, the piston 30 would advance in a direction away from the first end 5 of the hollow cylinder 3 until the orifice 39 was located on the side of the seal 12 that is adjacent the opening 11 from the hollow cylinder 3. With the orifice 39 in this position, the orifice is in communication with the atmosphere and hydraulic fluid that is supplied to the hydraulic cylinder 1 is vented to the atmosphere through the orifice and the pressure on the piston 30 reduced so that further advancement of the piston would cease. The leakage of the hydraulic fluid from the orifice 39 prevents the piston 30 from advancing to a point where it could result in injury or damage to equipment or individuals.

Figure 9:
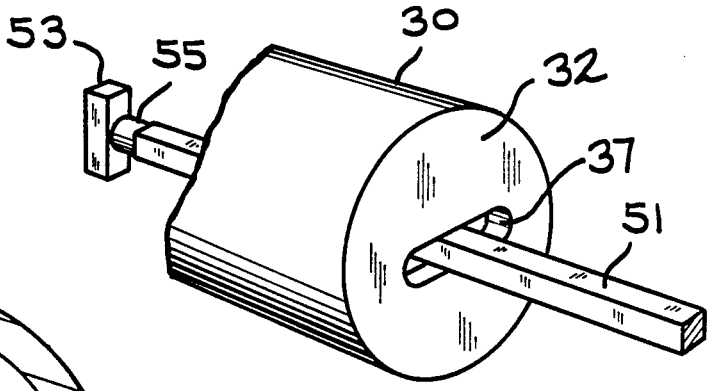
FIG. 9 is a partial perspective view of another embodiment of the invention.
Figure 10:
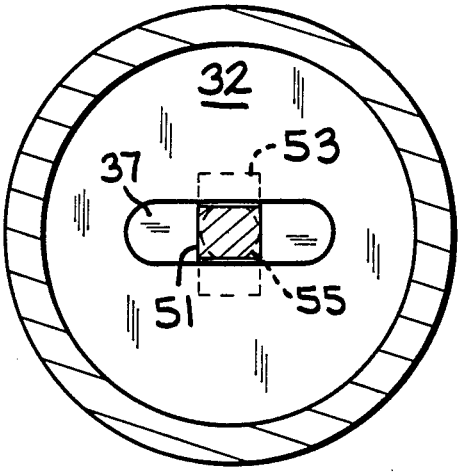
FIG. 10 is a cross-sectional view of another embodiment of the invention.

FIGS. 9 and 10 show another embodiment that can be utilized with the hydraulic cylinder of the present invention. This embodiment is substantially the same as the hydraulic cylinder previously described with the exception of the configuration of the rod that is used to retain the piston in the hollow cylinder of the hydraulic cylinder.

The moveable hollow piston 30 has a slot 37 in the first end 32 of the piston as previously described. A rod 51 is positioned in the interior of the hollow cylinder 3 and one end of the rod is secured to the first end 5 of the hollow cylinder. The rod has a substantially square cross section and is designed so that the sides of the substantially square rod are substantially the same length as the height of the slot 37. The end of the rod 51 that is spaced apart from the first end 5 of the hollow cylinder 3 has a T-shaped section that is secured to this end of the rod. The T-shaped section has the same substantially square cross section as the rod 51. The T-shaped section extends from each side of the rod 51 and the T-shaped section has a length that is from about $1\frac{1}{4}$ to about 3 times of the height of the slot 37. Immediately adjacent the T-shaped section 53 there is a section 55 of the rod 51 that has a substantially circular cross section. The diameter of the substantially circular section 55 is substantially the same as the length of the sides of the substantially square section of rod 51. The circular section 55 has a length that is at least as long as the thickness of the second end 32 of the piston 30. Normally, the length of the circular section 55 is from about $1\frac{1}{4}$ to about 2 times the thickness of the second end 32 of the piston 30.

The substantially square shape of the rod 51 prevents the piston 30 from being rotated when the slot 37 is positioned on the substantially square portion of the rod 51. It is only possible to rotate the piston 30 when the slot 37 is in communication with the circular section 55 on the rod 51. Accordingly, when the piston 30 is positioned on the rod 51 once the slot 37 clears the T-shape section 53, the piston 30 can be rotated while the slot 37 is in communication with the circular section 55. Once the piston 30 has been rotated substantially 90° so that the T-shaped section 53 is no longer in alignment with the slot 37, the piston 30 can be advanced onto the substantially square portion of the rod 51. Once the piston 30 is on the substantially square section of the rod 51, the piston 30 cannot be rotated to bring the T-shaped section 53 back into alignment with the slot 37. Thus, it is only possible to position the piston 30 for removal from the rod 51 by advancing the piston 30 in a direction towards the T-shaped section 53 so that the slot 37 is in alignment with the circular section 55 on the rod. This provides an additional safety feature to prevent the piston 30 from being accidently oriented so that the slot 37 and T-shaped section 53 are in alignment and the piston 30 can be removed from the rod 51.

The above description is given for the sake of explanation. Various modifications and substitutions, other than those cited, can be made without departing from the scope of the following claims.

What I claim is:

1. A hydraulic cylinder comprising:

a hollow cylinder having a closed first end and an open second end;

a rod positioned in the interior of said hollow cylinder, said rod being securely connected to said first end of said hollow cylinder, said rod being positioned in substantially the center of said hollow cylinder and being substantially parallel to said longitudinal axis of said cylinder, said end of said rod that is spaced apart from said first end of said hollow cylinder having an enlarged cross section;

a moveable hollow piston having a first end and a second end, said first end of said piston being positioned in said hollow cylinder, said second end of said piston extending from said open end of said hollow cylinder, said first end of said piston defining a slot for receiving said end of rod having an enlarged cross section; said slot being disposed to receive said end of said rod having an enlarged cross section when said slot and end of said rod are properly aligned, said piston being rotatable to change alignment between said slot and said end of said rod to prevent said piston from being removed from said rod and said cylinder.

2. The hydraulic cylinder of claim 1, wherein said area of enlarged cross section on said end of said rod that is spaced apart from said first end of said hollow cylinder is a T-shaped section that extends from each side of said rod.

3. The hydraulic cylinder of claim 2, wherein said T-shaped section has a height and a width, said height of said T-shaped section being substantially the same as said diameter of said rod, said width of said T-shaped section being at least 25% wider than said diameter of said rod.

4. The hydraulic cylinder of claim 3, wherein said slot in said piston has a width and a height, said width of said slot being sufficient to accept said width of said T-shaped section, said height of said slot being sufficient to accept said height of said T-shaped section and said diameter of said rod, said height of said slot being smaller than said width of said T-shaped section.

5. The hydraulic cylinder of claim 4, wherein said piston is rotatable, said piston being rotated approximately 90° after said rod has been inserted in said slot in said piston, said width of said T-shaped section being in alignment with said height of said slot after said rotation of said piston so that said piston can not be removed from said cylinder and said rod without rotating said piston to align said width of said slot with said width of said T-shaped section.

6. The hydraulic cylinder of claim 2, wherein said T-shaped section is from about 1¼ wider to about 3 times wider than said diameter of said rod.

7. The hydraulic cylinder of claim 1, wherein a cylindrical fitting is positioned on said first end of said hollow cylinder, a passageway being disposed in said cylindrical fitting, said passageway being positioned substantially perpendicular to said side walls of said hollow cylinder, a cylindrical bracket is positioned on said second end of said hollow piston, a passageway being disposed in said cylindrical bracket, said passageway being positioned substantially perpendicular to said side walls of said hollow cylinder, said cylindrical fitting and said cylindrical bracket being used to connect said hydraulic cylinder to a machine, said hydraulic cylinder being in the proper position for connection to said machine when the longitudinal axis of said passageway in said cylindrical fitting is substantially parallel to the longitudinal axis of said passageway in said cylindrical bracket.

8. The hydraulic cylinder of claim 7, wherein said longitudinal axis of said passageway of said cylindrical bracket is substantially perpendicular to said longitudinal axis of said passageway in said cylindrical fitting when said area of enlarged cross section on said rod is in alignment with said slot in said piston so that said piston can be positioned on and removed from said rod only when said hydraulic piston is not in a position to be connected to a machine.

9. The hydraulic cylinder of claim 1, wherein a seal is positioned on the interior of said hollow cylinder adjacent said second end, said seal extending around said interior circumference of said hollow cylinder, said seal being disposed to be substantially perpendicular to said longitudinal axis of said hollow cylinder.

10. The hydraulic cylinder of claim 1, wherein said rod has a substantially square cross section, said rod having a section, adjacent said area of enlarged cross section having a substantially circular cross section; said sides of said square cross section of rod having a length slightly smaller than said height of said slot in said first end of hollow piston so that said piston can slide along said rod but can not rotate when said slot is positioned on said portion of said rod with a square cross section, said section of rod having a circular cross section having a diameter smaller than said height of said slot so that said piston can rotate when said slot is in alignment with said section of said rod having a circular cross section.

11. The hydraulic cylinder of claim 10, wherein said section of said rod having a circular cross section has a length that is longer than said thickness of said first end of said hollow piston where said slot is located.

12. The hydraulic cylinder of claim 11, wherein said length of said section is from about 1¼ to about 2 times the thickness of said first end of said piston.

13. A hydraulic cylinder comprising:

a hollow cylinder having a closed first end and an open second end;

a seal positioned on the interior of said hollow cylinder adjacent said second end, said seal extending around said interior circumference of said hollow cylinder, said seal being disposed to be substantially perpendicular to said longitudinal axis of said hollow cylinder;

a rod positioned in the interior of said hollow cylinder, said rod being securely connected to said first end of said hollow cylinder, said rod being positioned in substantially the center of said hollow cylinder and being substantially parallel to said longitudinal axis of said cylinder, said end of said rod that is spaced apart from said first end of said hollow cylinder having an enlarged cross section, said area of enlarged cross section having a height and a width, said height of said section being substantially the same as said diameter of said rod, said width of said section being at least 25% wider than said diameter of said rod;

a moveable hollow piston having a first end and a second end, said first end of said piston being positioned in said hollow cylinder, said second end of said piston extending from said open end of said hollow cylinder, said first end of said piston defining a slot for receiving said end of rod having an enlarged cross section; said slot being disposed to receive said end of said rod having an enlarged cross section when said slot and end of said rod are properly aligned, said piston being rotatable to change alignment between said slot and said end of said rod to prevent said piston from being removed from said rod and said cylinder;

an orifice positioned in said piston adjacent said first end of said piston, said orifice extending through said piston and being in communication with the hollow interior of said piston, said orifice being positioned between said seal and said first end of said cylinder when said piston is properly positioned on said rod, said orifice being positioned on the side of said seal adjacent said second end of said cylinder and in communication with the atmosphere when said piston has moved beyond the desired length of travel along said rod so that said hydraulic fluid is vented to the atmosphere and any further movement of said piston is stopped.

14. The hydraulic cylinder of claim 13, wherein said area of enlarged cross section on said end of said rod that is spaced apart from said first end of said hollow cylinder is a T-shaped section that extends from each side of said rod.

15. The hydraulic cylinder of claim 14, wherein said T-shaped section is from about 1¼ wider to about 3 times wider than said diameter of said rod.

16. The hydraulic cylinder of claim 15, wherein said slot in said piston has a width and a height, said width of said slot being sufficient to accept said width of said T-shaped section, said height of said slot being sufficient to accept said height of said T-shaped section and said diameter of said rod, said height of said slot being smaller than said width of said T-shaped section.

17. The hydraulic cylinder of claim 16, wherein said piston is rotatable, said piston being rotated approximately 90° after said rod has been inserted in said slot in said piston, said width of said T-shaped section being in alignment with said height of said slot after said rotation of said piston so that said piston can not be removed from said cylinder and said rod without rotating said piston to align said width of said slot with said width of said T-shaped section.

18. A hydraulic cylinder comprising:

a hollow cylinder having a closed first end and an open second end;

a seal positioned on the interior of said hollow cylinder adjacent said second end, said seal extending around said interior circumference of said hollow cylinder, said seal being disposed to be substantially perpendicular to said longitudinal axis of said hollow cylinder;

a rod positioned in the interior of said hollow cylinder, said rod being securely connected to said first end of said hollow cylinder, said rod being positioned in substantially the center of said hollow cylinder and being substantially parallel to said longitudinal axis of said cylinder, said end of said rod that is spaced apart from said first end of said hollow cylinder having an enlarged cross section;

a moveable hollow piston having a first end and a second end, said first end of said piston being positioned in said hollow cylinder, said second end of said piston extending from said open end of said hollow cylinder, said first end of said piston defining a slot for receiving said end of rod having an enlarged cross section; said slot being disposed to receive said end of said rod having an enlarged cross section when said slot and end of said rod are properly aligned, said piston being rotatable to change alignment between said slot and said end of said rod to prevent said piston from being removed from said rod and said cylinder;

an orifice positioned in said moveable piston, said orifice being disposed adjacent said first end of said piston, said orifice passing through said side wall of said piston and being in communication with said hollow interior of said piston, said orifice being disposed between said seal and said first end of said hollow cylinder when said piston is properly positioned in said hollow cylinder, said orifice moving beyond said seal in a direction towards said second end of said hollow cylinder when said piston has moved beyond its desired operating range and said orifice communicating with the atmosphere so that hydraulic fluid used to operate said hydraulic cylinder is vented to the atmosphere and said movement of said piston is stopped.

19. The hydraulic cylinder of claim 18, wherein said orifice is disposed on said piston so that said orifice is positioned on the side of said seal that is adjacent said second end of said hollow cylinder and said orifice is in communication with the atmosphere when said first end of said piston has advanced in a direction towards said second end of said hollow cylinder past said area of enlarged cross section on said rod so that said hydraulic fluid is vented to said atmosphere and said piston stops moving so that said orifice acts as a safety device to prevent said piston from moving beyond a desired range of travel if there is a failure in the operation of said rod and said slot in said piston to limit the travel of said piston during the operation of said hydraulic cylinder.

* * * * *